US007392551B2

(12) United States Patent
Lanius

(10) Patent No.: US 7,392,551 B2
(45) Date of Patent: Jul. 1, 2008

(54) MULTI-PIECE WALL BATHING ENCLOSURE

(75) Inventor: Jason T. Lanius, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 355 days.

(21) Appl. No.: 11/063,293

(22) Filed: Feb. 22, 2005

(65) Prior Publication Data

US 2005/0188459 A1 Sep. 1, 2005

Related U.S. Application Data

(60) Provisional application No. 60/547,339, filed on Feb. 24, 2004.

(51) Int. Cl.
*A47K 3/30* (2006.01)

(52) U.S. Cl. ..... 4/608; 4/605; 4/613; 4/614; 248/298.1; 248/307

(58) Field of Classification Search ..... 4/557–559, 4/605, 607, 608, 612–614; 52/553; 248/215, 248/298.1, 307, 339, 340
See application file for complete search history.

(56) References Cited

U.S. PATENT DOCUMENTS

| | | | | |
|---|---|---|---|---|
| 345,918 | A * | 7/1886 | Palmer | 4/559 |
| 505,360 | A | 9/1893 | Hilliard | |
| 970,485 | A | 9/1910 | Frey | |
| 1,198,184 | A | 9/1916 | Bonnabeau | |
| 2,672,314 | A | 3/1954 | Mitchell | |
| 3,140,557 | A | 7/1964 | Albrycht | |
| 3,609,773 | A | 10/1971 | Mustee | |
| 4,398,309 | A | 8/1983 | Simons | |
| 4,564,963 | A | 1/1986 | Bergmark | |
| 4,807,310 | A | 2/1989 | Sedala | |
| 4,901,380 | A | 2/1990 | Smith | |
| 4,998,304 | A | 3/1991 | Sauter et al. | |
| 6,932,310 | B1 * | 8/2005 | Diss | 248/339 X |
| 2003/0097810 | A1 * | 5/2003 | Leichtfried | 52/553 X |

* cited by examiner

*Primary Examiner*—Robert M Fetsuga
(74) *Attorney, Agent, or Firm*—Quarles & Brady LLP

(57) ABSTRACT

A bathing enclosure has a wall arrangement which supports one or more hanging accessories, such as a towel hook, soap dish and bottle rack. Multiple wall sections are mounted so that their top and bottom edges are spaced apart to create a lateral gap therebetween. The gap permits a hanger end of the accessories to fit up and over the upper edges of the wall sections. The accessories can be slid horizontally in the gap and either extend to the inside or outside of the enclosure. Preferably, adjacent wall sections overlap vertically and tilt backward toward the inside of the enclosure from top to bottom.

17 Claims, 6 Drawing Sheets

MULTI-PIECE WALL BATHING ENCLOSURE

CROSS-REFERENCE TO RELATED APPLICATIONS

This application claims benefit to U.S. Provisional Patent Application No. 60/547,339, filed Feb. 24, 2004.

STATEMENT OF FEDERALLY SPONSORED RESEARCH OR DEVELOPMENT

Not applicable.

BACKGROUND OF THE INVENTION

The present invention relates to bathing enclosures and in particular to enclosure wall structures having an accessory moveable mounted thereon.

A variety of bathtub and shower enclosures are well known. Typically, an enclosure includes three walls (in the case of a lateral wall enclosure) or two walls (in the case of a corner enclosure) to define a showering/bathing area. The enclosure walls can be tiled or made of a water resistant material, such as glass or plastic. An opening to the enclosure is generally closed off by a door or curtain which allows entry into the enclosure while preventing water from splashing outside the enclosure.

The tub/shower can be a formed insert with surrounding walls. U.S. Pat. No. 4,901,380 discloses such a bath/shower insert in which the surround walls have a horizontal seam allowing an upper section of the walls to be separated for transport prior to installation.

Free-standing and portable shower stalls have also been devised. See e.g., U.S. Pat. Nos. 3,609,773 and 4,807,310. These shower stalls have wall segments that connect together along vertical seams to form a four-sided enclosure with a door or curtain covered opening. The walls may have openings to vent the enclosure.

It is also known to mount accessory fixtures inside a bathing enclosure. Common accessories include shelves, dishes, racks and hooks for holding various personal hygiene items, such as soaps, hair products, shaving implements, exfoliators and cloths. These accessories are typically permanently mounted to the enclosure walls and/or the door using anchored fasteners or waterproof adhesives. Alternatively, they may be integrally formed with the enclosure wall. Once the accessory is mounted in place it cannot be relocated easily, and even if it were re-installed elsewhere, the unsightly damage done to the original mounting surface would become visible.

Other shower accessories mounting systems have been devised. A "shower caddy" is one such accessory which includes a hook or strap that fits around the spout of the shower head. The shower caddy has one or more small shelves typically used to hold shampoo bottles and razors.

U.S. Pat. Nos. 505,360 and 970,485 disclose soap holders with inverted U-shaped hooks at one end that can be used to hang the soap holders from a side of the tub. U.S. Pat. No. 3,140,557 discloses a soap dish on a long hanger with either a hooked end to fit around the shower curtain rod or a holed end for fitting onto a shower curtain ring.

U.S. Pat. No. 4,998,304 discloses a more sophisticated system in which the accessory has a flanged end that fits within a track in the frame header. The accessory can be slid horizontally in the track to change its position.

While the accessory systems of the aforementioned patents allow for some position adjustment, many are somewhat unstable and some may interfere with entering and exiting the enclosure. Moreover, the degree of adjustment is typically quite limited.

Thus, a need exists for an improved system for enclosing bathing areas and moveably mounting bathing accessories thereon.

SUMMARY OF THE INVENTION

The invention provides a bathing enclosure, which is defined herein to include without limitation a shower stall, a bathtub enclosure, a combination shower and bath enclosure and any other enclosed or partially enclosed area in which a person is sprayed with or immersed in water or other cleaning liquid.

In one aspect, the bathing enclosure of the present invention includes at least one side support, two wall sections and an accessory. The wall sections are mounted to the side support so that an upper edge of one wall is spaced from a lower edge of the other wall section to define a lateral gap between the wall sections. The accessory is suspended from and slideable along the upper edge of one wall section. A portion of the accessory extends into the gap so that it may be slid along the gap.

In most preferred forms, the wall sections overlap one another vertically. In other words, the lower edge of the higher wall section is vertically below the upper edge of the lower wall section. This arrangement acts to keep water from splashing outside the enclosure, which is particularly beneficial when the bathing enclosure is used for showering.

Alternatively, the lower edge of the upper wall section could be essentially at the same (or even a greater height) than the upper edge of the lower wall section. In the latter case, the vertical spacing is preferably kept to a short distance to limit splashing outside of the enclosure.

The wall sections could be mounted between two side supports in a vertically staggered pattern in which the wall sections are disposed in separate parallel vertical planes. More preferably, they could be mounted in a louvered arrangement in which the wall sections are oriented at oblique angles to vertical, preferably parallel to one another, so as to intersect the side support(s) diagonally, preferably sloping backward (toward the inside of the enclosure) from top to bottom.

In other preferred forms there can be three or more wall sections, each defining lateral (in the direction of outside to inside) gaps between adjacent wall sections, and preferably vertically overlapping the adjacent wall section(s). The wall sections can be rectilinear panels, or the wall sections can have one or more curved surfaces, such as a bowed face or curved edges, for example resembling a particular shape or object, such as a wind sail. The wall sections can be rigid, such as made of glass or plastic having transparent, translucent, diffuse or opaque characteristics, or could be of a flexible material, such as a fabric.

The wall sections provide a unique mounting arrangement for one or more bathing accessories. The accessories can include towel hooks, soap dishes and hair treatment bottle racks, for example. Each accessory has a hanger feature allowing it to hook over the upper edge of a wall section. Thus, installation is easy and there is no need to put holes in any wall surfaces. Moreover, the position of the accessories can be adjusted easily. An accessory can be slid essentially horizontally along the edge of the associated wall section to the desired location. The height of the accessory can be changed by hanging it from a different wall section. The accessories can be mounted so that their carrier portion (e.g., hook, tray or shelf) extends either to the inside of the enclosure or to the outside of the enclosure. Thus, a towel hook, for example, could be mounted so that a towel hung thereon could be outside of the enclosure to keep it dry, while a soap dish could be mounted so that the soap can be reached from inside the enclosure.

In still other forms the present invention can include a curtain rod mounted to a side support. The side support(s) can be supported by a platform having an angled floor and a drain opening. A floor insert with improved tactility or comfort, such as a bamboo mat, can be supported by the platform.

These and other advantages of the invention will be apparent from the detailed description and drawings.

DETAILED DESCRIPTION OF THE PREFERRED EMBODIMENTS

Figure 1:
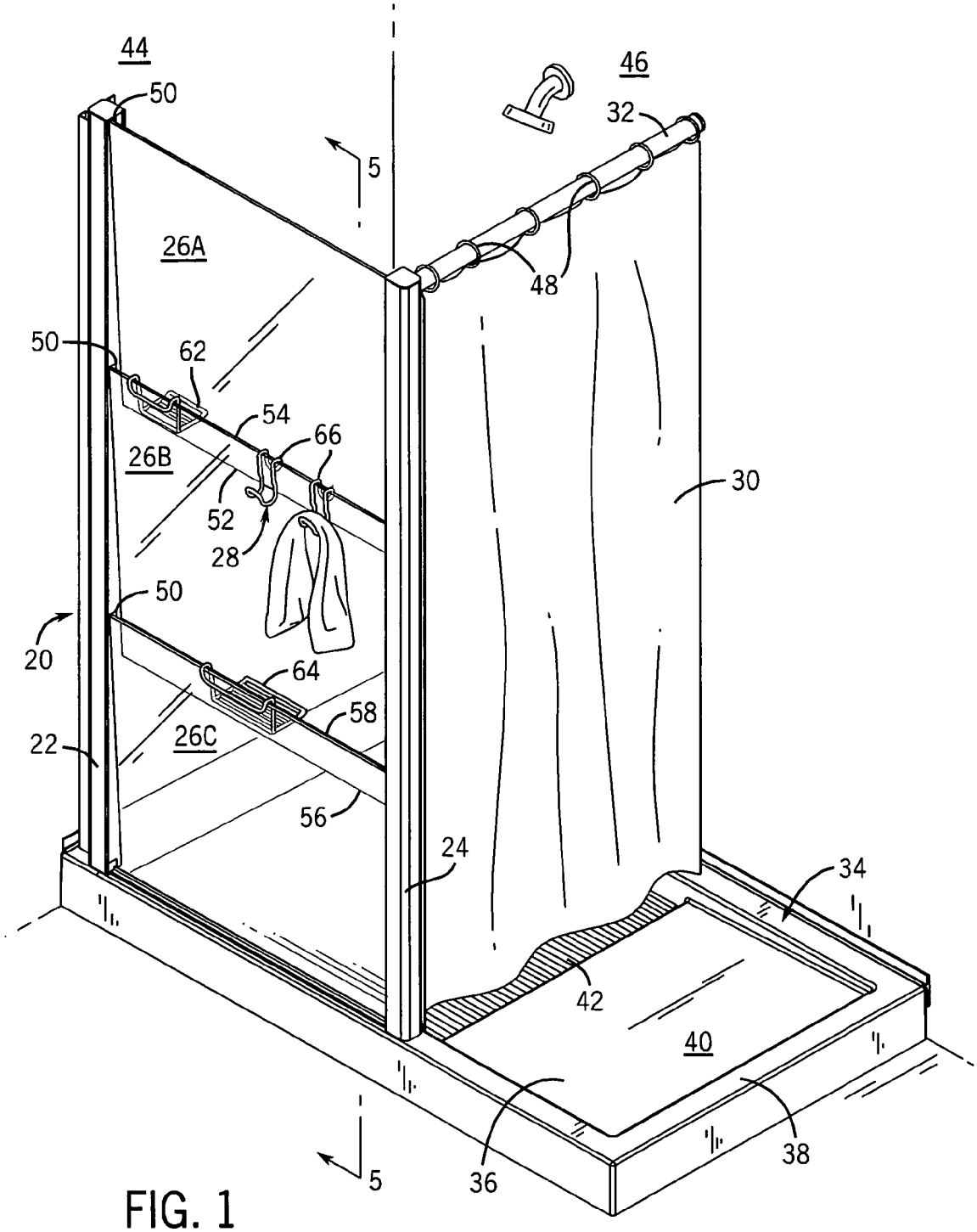
FIG. 1 is a perspective view of a preferred embodiment of the bathing enclosure of the present invention.
Figure 2:
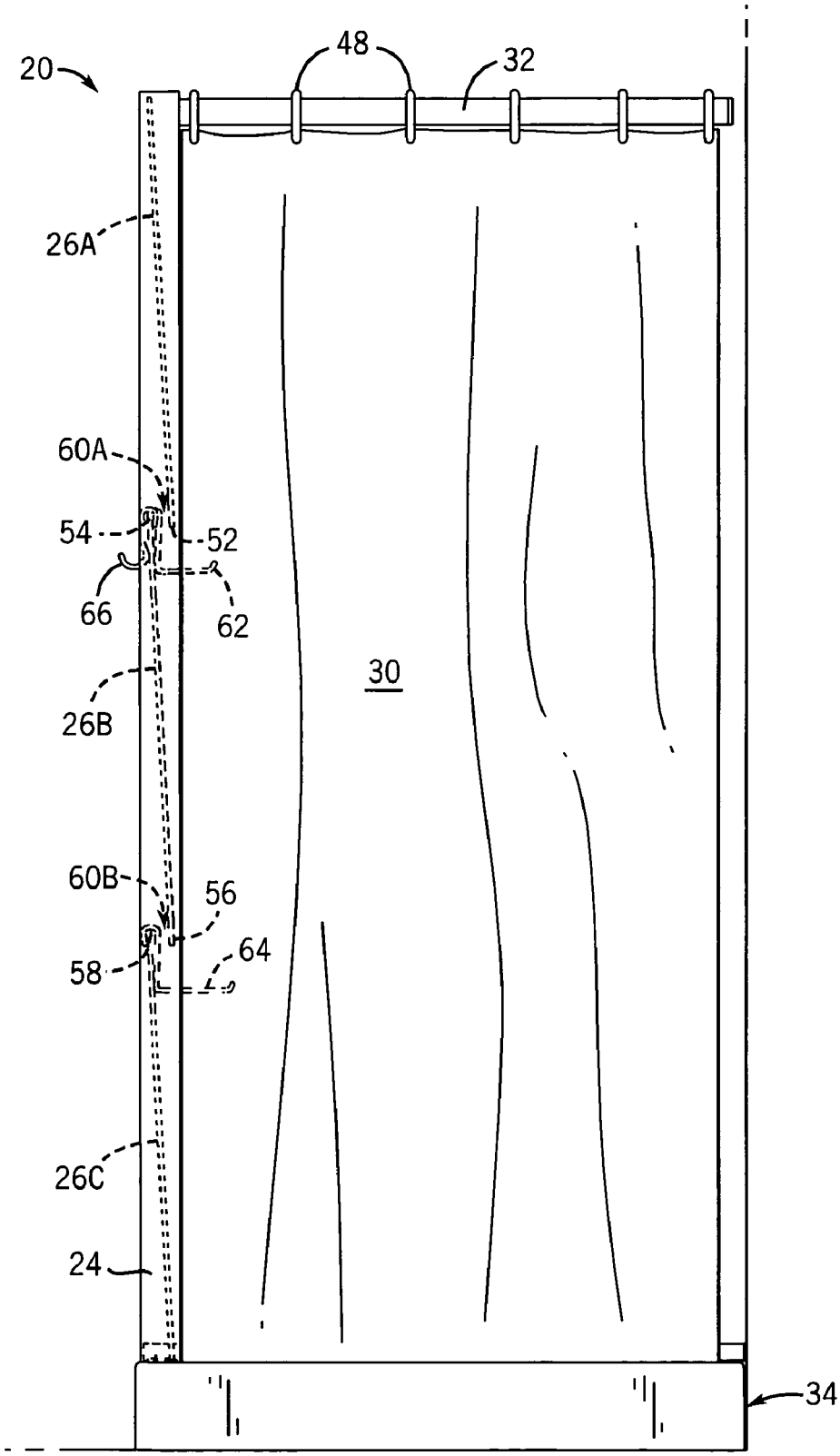
FIG. 2 is an end elevational view thereof.
Figure 3:
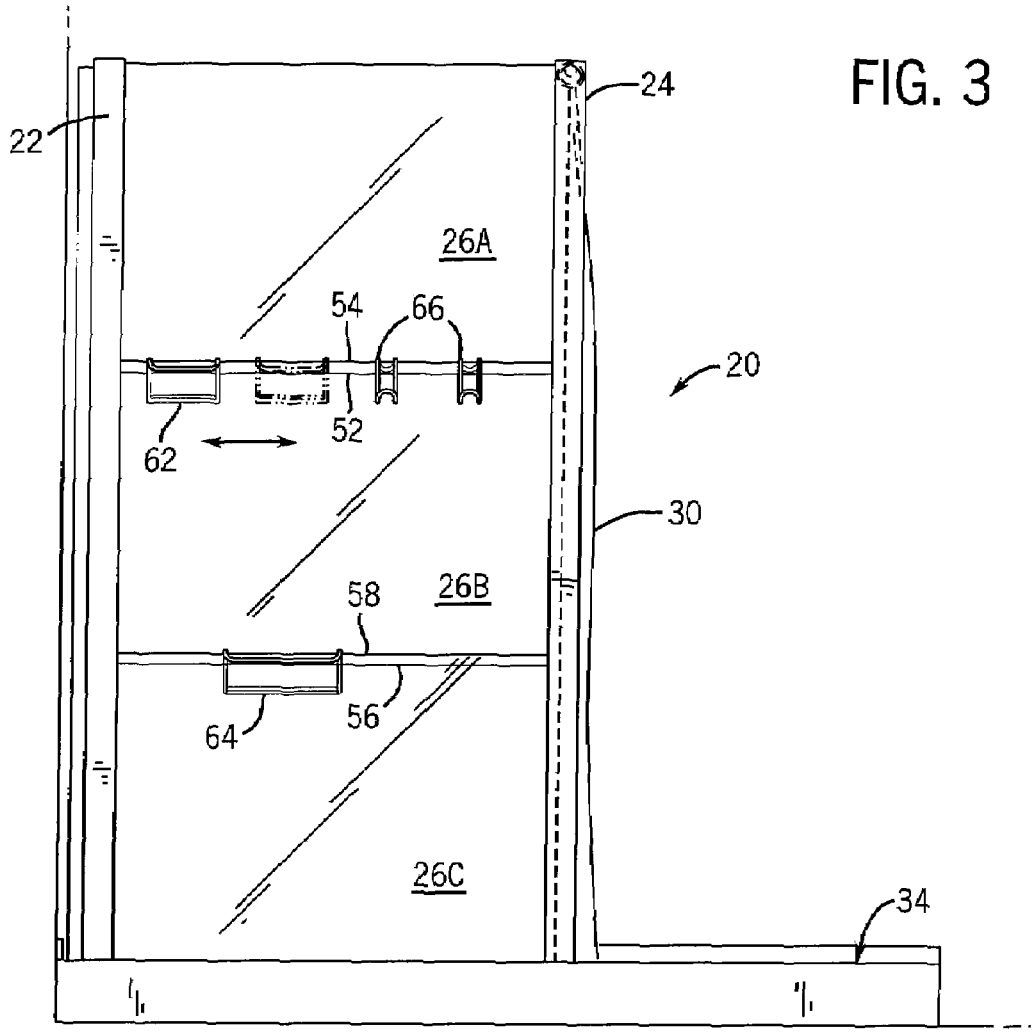
FIG. 3 is a front side elevational view thereof.
Figure 4:
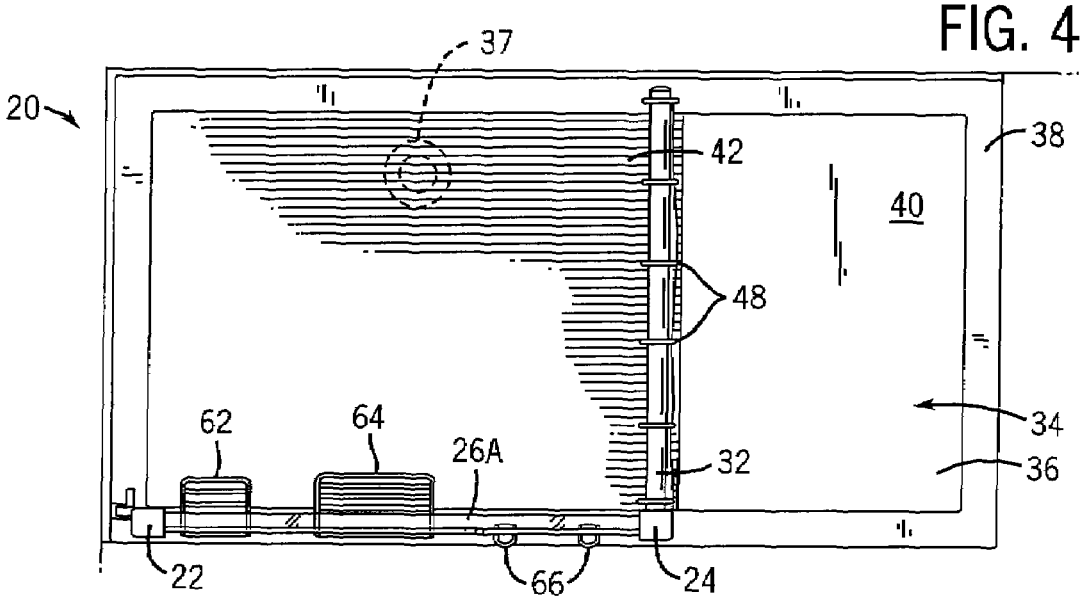
FIG. 4 is a top plan view thereof.
Figure 5:
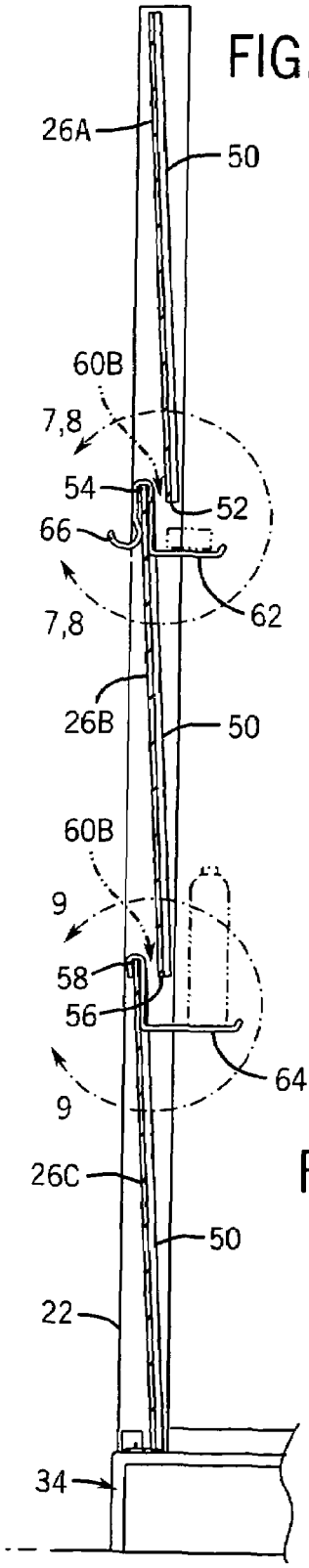
FIG. 5 is a cross-sectional view taken along line 5-5 of FIG. 1 showing the louvered wall sections enlarged.

The present invention provides a bathing enclosure shown in one form and generally referred to by reference number 20 in FIGS. 1-9. The enclosure is designed to provide a fully enclosed (4-sided as in FIGS. 1-9), or partially enclosed (2-sided as in FIG. 11, or 3-sided as in FIG. 10) enclosure using one or two existing walls of the building where the enclosure is installed. The figures show the enclosure as a shower stall unit. However, it is within the scope of the invention for the enclosure to completely or partially surround other arrangements such as bath tub, whirlpool, spa, pool or any other such bathing basin.

Referring to FIGS. 1-4, the enclosure 20 generally includes a pair of support columns 22 and 24, wall sections 26A-26C, accessories (collected referred to by numeral 28 in FIG. 1), a curtain 30 and rod 32, and a platform 34. The platform 34 is tray-shaped base with a sloped floor 36 designed to direct water to a drain opening 37 in the floor 36. A raised edge 38 extends around the perimeter of the floor 36 to contain the water. The platform 34 is sized larger then the enclosed area of the enclosure 20 to provide a transition area 40 where an exiting bather can stand to dry off before walking onto the main floor.

Preferably, the section of the floor 36 inside the walls of the enclosure 20 has an insert 42 which has a desirable quality for standing on, for example, having a wood feel or being softer or more tactile to reduce slipping. One preferred form of the floor insert is a wooden mat, such as teak or bamboo. Rubber or foam mats could also be used.

The platform 34 provides the base for the enclosure 20. The support columns 22 and 24 are anchored to the platform 34 at their bottom ends in any suitable manner and extend vertically upwardly in parallel to each other and building walls 44 and 46. Support column 22 can also be anchored to the wall 44 near its middle and upper end. The upper end of the support column 22 is anchored to wall 46 by the curtain rod 32. As is conventional, the curtain rod 32 hangs the movable curtain 30, for example, using curtain rings 48.

The support columns 22 and 24 have a series of diagonal slots 50 in which ends of the wall sections 26 fit. The ends of the wall sections can be anchored or free floating within the slots 50. In the preferred embodiment shown in FIGS. 1-9, there are three wall sections 26A-26C extending generally horizontally between the support columns 22 and 24 and arranged vertically one above the other in overlapping fashion. More specifically, the wall sections 26A-26C are canted backward going from outside to inside the enclosure 20. The lower edge 52 of the upper wall section 26A is vertically below the upper edge 54 of the middle wall section 26B which has its lower edge 56 vertically below the upper edge 58 of the lower wall section 26C. Thus, each wall section overlaps the adjacent wall section. This is preferred to reduce the occurrence of water splashing outside the enclosure 20 between wall sections.

Because the wall sections are canted at an oblique angle relative to vertical, a lateral (i.e., in the direction from outside to inside the enclosure) gap is formed between adjacent wall sections. In the embodiment of FIGS. 1-9 with three wall sections 26A-26C, there are two gaps 60A and 60B.

Advantageously, these gaps provide a place to mount one or more of the accessories 28, which for example can include the soap dish 62, bottle rack 64 and towel hooks 66 (two shown) illustrated in FIG. 1. In one embodiment, these accessories are of a rubber coated metal wire frame construction to avoid surfaces tending to collect water. Referring to FIGS. 5-9, each of the accessories has a hanger end 70, generally having a cane or inverted "U" shape that can hook onto an upper edge of a wall section.

In the preferred embodiment of the invention in which the walls sections overlap one another, the accessories each preferably have a neck 72 that extends between the hanger end 70 and a carrier portion 74 which extends in a generally horizontal direction either toward or away from the inside of the enclosure 20. Note that the carrier portions can be hooks, shelves, trays or any other structures for support bathing items. The extension of the neck 72 is shaped as needed to extend between the overlapping portion of the wall sections to clear the carrier portion 74 from the lower edge of the higher wall section so that the carrier portion can extend out at the proper angle, such as essentially parallel to the room floor.

Figure 6:
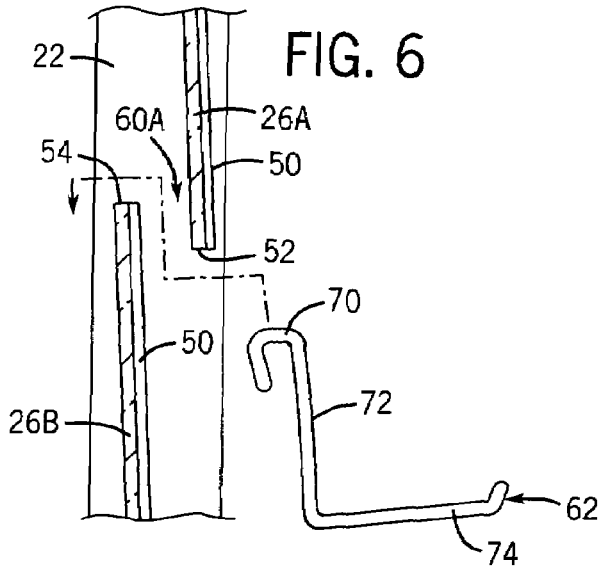
FIG. 6 is an enlarged sectional view taken along arc 7,8-7,8 of FIG. 5 showing the mounting of a soap dish accessory to a top edge of a middle wall section.
Figure 7:
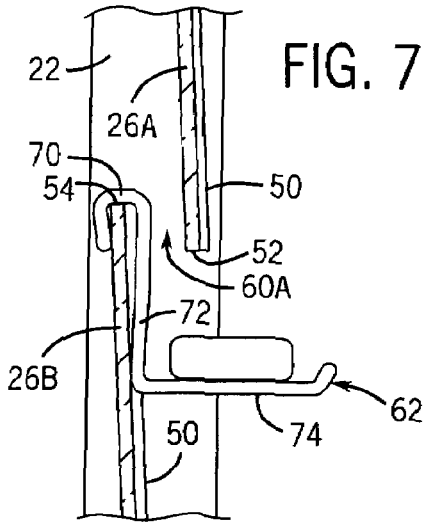
FIG. 7 is a view similar to FIG. 6 with the soap dish shown hanging from the middle wall section.
Figure 8:
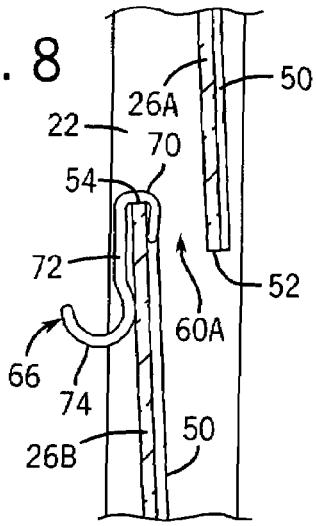
FIG. 8 is an enlarged sectional view taken along arc 7,8-7,8 of FIG. 5 showing a towel hook accessory hanging from the middle wall section with a carrier hook at the outside of the enclosure.

The neck 72 and the hanger 70 are sized small enough to fit into the gaps 60A and 60B between adjacent wall sections such that accessories can be mounted, for example, from the inside of the enclosure to a wall section that is overlapped to the inside of the enclosure, as all of the wall sections are in the disclosed embodiment. This is illustrated in FIGS. 6 and 7, which show that the hanger end 70 of the soap dish 62 is inserted up into the gap 60A between wall sections 26A and 26B and then lowered onto the upper edge of wall section 26B.

Figure 9:
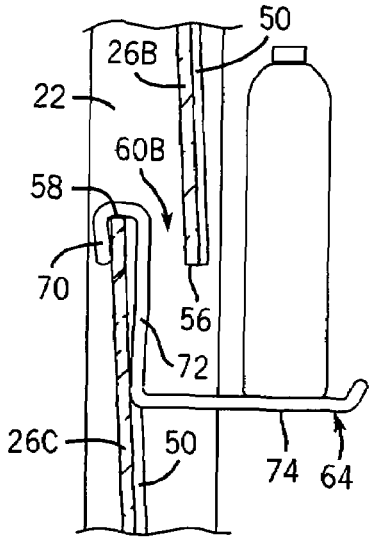
FIG. 9 is an enlarged sectional view taken along arc 9-9 showing a bottle rack accessory hanging from a lower wall section with a carrier shelf portion inside of the enclosure.

Similarly, FIG. 9 illustrates the bottle rack 64 hung from wall section 26C at the inside of the enclosure 20. The accessories can also be hung to extend toward the outside of the enclosure, for example, to hold items that need to be kept dry, as are the towel racks 66 shown in FIG. 8. In any case, the accessories can be positioned anywhere along the edge of the wall sections, and repositioned easily by sliding them sidewise. They are also easily removed by lifting them up and away from the wall section to unhook them and then lowering them out of the gap. The accessories can then be moved to a different wall section, thereby providing for adjustment in height, or removed entirely from the enclosure.

Figure 10:
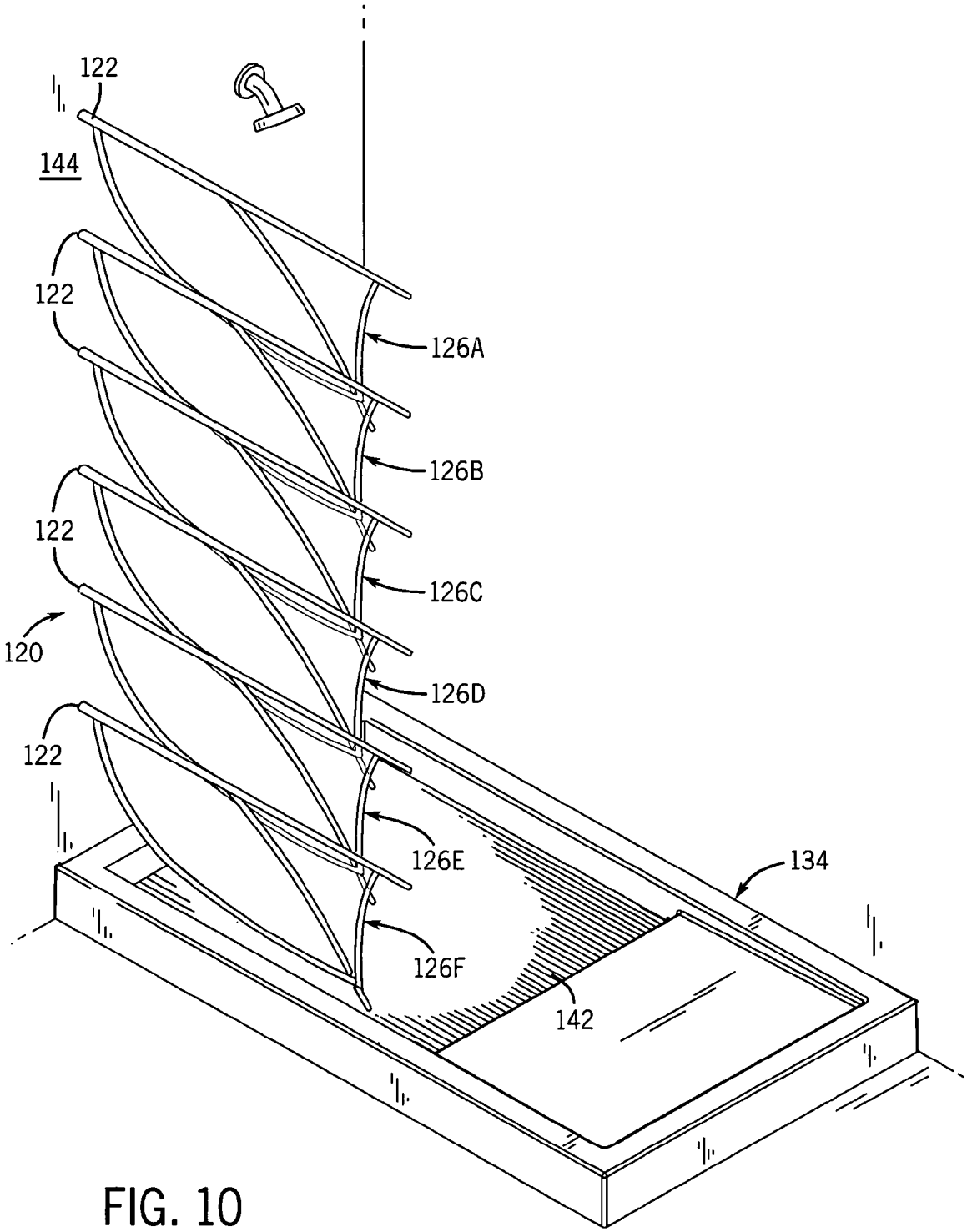
FIG. 10 is a perspective view of a first alternate embodiment of the bathing enclosure of the present invention, in which the wall sections have a non-rectilinear configuration.

FIG. 10 shows a first alternate embodiment of the bathing enclosure of the present invention. This embodiment is referred to in the drawings using like reference numbers as above albeit now in the one hundreds. The enclosure 120 of this embodiment is different from that described above, primarily in that it is a three-sided enclosure (i.e., there is no door or curtain closing off the fourth side) and the configuration of the wall sections 126A-126F is different. Also, the side supports are horizontal rods 122 cantilevered at one end to the wall 144. The wall sections are non-rectilinear and have curved edges that give the enclosure 120 a unique aesthetic, perhaps resembling sails or having a feathered look.

It is envisioned that the wall sections could be made of a flexible material, such as a cloth, which could move in response to air currents or the splash of water, thereby achieving a still more enhanced aesthetic effect. Like the previous embodiment, the wall sections overlap adjacent walls sections in that their lower edges, at least in part, extend vertically below the upper edges of the adjacent lower wall sections. Like before, the enclosure 120 of this embodiment includes a platform 134 and a mat insert 142. Also, although not shown, adjacent wall sections are spaced apart to define lateral gaps as described in the preceding embodiment such that accessories can be hung from the support rods of the wall sections in a similar manner to that described above.

Figure 11:
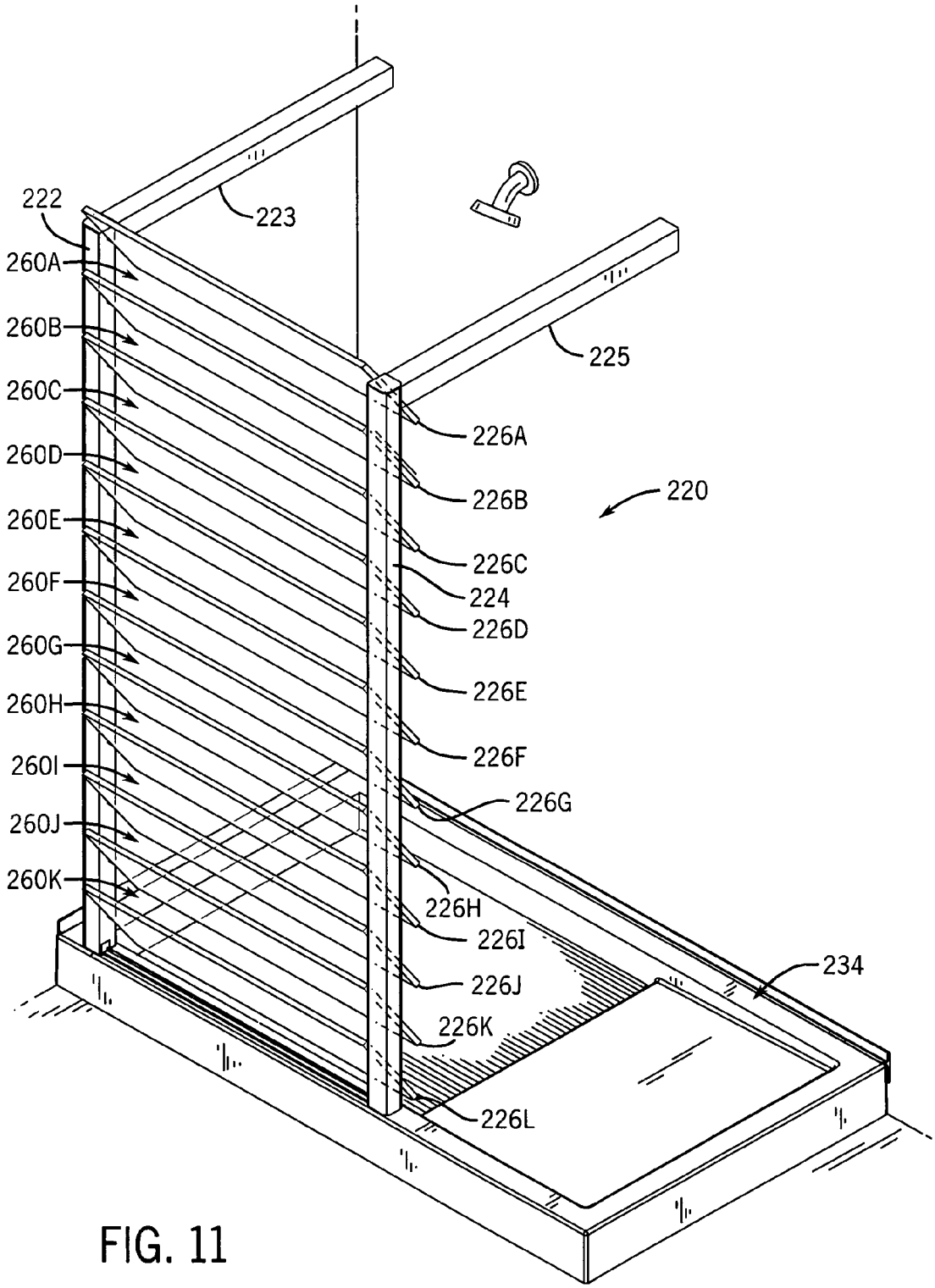
FIG. 11 is a perspective view of an another alternate bathing enclosure with more numerous smaller sized wall sections.

FIG. 11 shows another alternate bathing enclosure. This embodiment is referred to in the drawings using reference numbers like those above albeit in the two hundreds. Here, the enclosure 220 is generally two-sided and has two vertical support columns 222 and 224 mounted on platform 234 and two horizontal brace members 223 and 225 that extend between the upper ends of the support columns and an opposite wall.

Like the first described embodiment, the support columns 222 and 224 mount individual wall sections, which in this case are smaller and more numerous, for example twelve wall sections 226A-226L are shown in FIG. 11. The lateral ends of each of the wall sections can have a central mounting post (not shown) which is received in corresponding holes in the support columns. The wall sections are fixedly mounted, for example, in an overlapping oblique angled arrangement as shown in FIG. 11 in which the wall sections are in parallel and canted downward from outside to inside of the enclosure. This arrangement creates lateral gaps 260A-260K which allow accessories (not shown), of the hanger type described above, to be suspended from the upper edges of the wall sections.

Preferred embodiments of the invention have been described in detail. However, the invention may be applied in a variety of other embodiments which are within the scope of the invention. Thus, to ascertain the full scope of the invention, the following claims should be referenced.

INDUSTRIAL APPLICABILITY

The invention provides a bathing enclosure with a segmented wall allowing for multiple hanger accessories to be adjustably mounted thereon.

I claim:

1. A bathing enclosure, comprising:

a pair of side supports;

first and second wall sections having translucent panels mounted to the side supports, wherein the first wall section has an upper edge spaced laterally from a lower edge of the second wall section so as to define a gap between the wall sections and wherein the first wall section upper edge is vertically above the second wall lower edge; and an accessory suspended from the upper edge of the first wall section and extending into the gap;

whereby the accessory may be slid along the upper edge.

2. The bathing enclosure of claim 1, wherein the side supports are slotted to receive an end of each wall section.

3. The bathing enclosure of claim 1, wherein the first wall section is parallel to the second wall section.

4. The bathing enclosure of claim 1, wherein at least one wall section is mounted at an oblique angle relative to vertical.

5. The bathing enclosure of claim 4, wherein the first and second wall sections are essentially parallel.

6. The bathing enclosure of claim 1, wherein at least one wall section extends diagonally backward from top to bottom.

7. The bathing enclosure of claim 1, wherein the accessory has a hanger.

8. The bathing enclosure of claim 1, wherein the accessory has a carrier that extends to an inside of the enclosure.

9. The bathing enclosure of claim 1, wherein the accessory has a carrier that extends to an outside of the enclosure.

10. The bathing enclosure of claim 1, wherein there are multiple such accessories.

11. The bathing enclosure of claim 1, wherein the accessory is selected from the group consisting of towel hooks, soap dishes, bottle racks and other bathroom accessories.

12. The bathing enclosure of claim 1, wherein there are more than two wall sections defining lateral gaps between adjacent wall sections.

13. A bathing enclosure, comprising:

a pair of side supports;

first and second wall sections mounted to the side supports, wherein the first wall section has an upper edge spaced laterally from a lower edge of the second wall section so as to define a gap between the wall sections; and an accessory suspended from the upper edge of the first wall section and extending into the gap;

whereby the accessory may be slid along the upper edge;

wherein the first wall section upper edge is vertically above the second wall lower edge; and further comprising a curtain rod mounted to the side supports.

14. The bathing enclosure of claim 1, further comprising a platform supporting the side supports.

15. The bathing enclosure of claim 14, further including a floor insert supported by the platform.

16. The bathing enclosure of claim 1, wherein there are more than two such wall sections and wherein at least one of the wall sections vertically overlaps two of such wall sections.

17. A bathing enclosure, comprising:

a platform defining a sloped floor, a drain opening and a raised edge extending about the floor;

a pair of side supports mounted to the platform;

first and second wall sections mounted to the side supports, wherein the first wall section has an upper edge spaced laterally from a lower edge of the second wall section so as to define a gap between the wall sections and wherein the first wall section upper edge is vertically above the second wall lower edge; and an accessory suspended from the upper edge of the first wall section and extending into the gap, whereby the accessory may be slid along the upper edge.

* * * * *